US005616987A

United States Patent [19]

Ohmura et al.

[11] Patent Number: 5,616,987

[45] Date of Patent: Apr. 1, 1997

[54] ELECTRON MULTIPLIER

[75] Inventors: Takayuki Ohmura; Tomoyuki Okada; Hiroyuki Kyushima; Yousuke Oohashi, all of Hamamatsu, Japan

[73] Assignee: Hamamatsu Photonics K.K., Shizuoka-ken, Japan

[21] Appl. No.: 560,122

[22] Filed: Nov. 17, 1995

[30] Foreign Application Priority Data

Nov. 18, 1994 [JP] Japan ..... 6-285069

[51] Int. Cl.[6] ..... H01J 43/20

[52] U.S. Cl. ..... 313/533; 313/534; 313/537; 313/103 R; 313/105 R

[58] Field of Search ..... 313/528, 533, 313/534, 535, 536, 541, 542, 103 R, 103 CM, 105 CM, 105 R, 387, 379, 537, 529, 382, 383

[56] References Cited

U.S. PATENT DOCUMENTS

| | | | |
|---|---|---|---|
| 3,119,037 | 1/1964 | Stanley | 313/105 R X |
| 4,311,939 | 1/1982 | Faulkner et al. | 313/95 |
| 4,431,943 | 2/1984 | Faulkner et al. | 313/533 |
| 4,825,066 | 4/1989 | Nakamura et al. | 313/533 X |
| 5,363,014 | 11/1994 | Nakamura | 313/534 X |
| 5,371,435 | 12/1994 | Ohishi et al. | 313/105 CM X |
| 5,504,386 | 4/1996 | Kyushima et al. | 313/532 X |

FOREIGN PATENT DOCUMENTS

| | | |
|---|---|---|
| 0345888 | 12/1989 | European Pat. Off. . |
| 0539229 | 4/1993 | European Pat. Off. . |
| 63-254652 | 10/1988 | Japan . |
| 254859 | 2/1990 | Japan . |
| 233847 | 2/1990 | Japan . |
| 2227951 | 9/1990 | Japan . |
| 2291656 | 12/1990 | Japan . |
| 5114384 | 5/1993 | Japan . |
| 2086648 | 5/1982 | United Kingdom . |

*Primary Examiner*—Sandra L. O'Shea
*Assistant Examiner*—Ashok Patel
*Attorney, Agent, or Firm*—Sughrue, Mion, Zinn, Macpeak & Seas

[57] ABSTRACT

A mesh electrode 9 is provided over an incident opening 7a of the electron multiplication portion 6. In the electron multiplication portion 6, a dynode group Dy is located downstream of a first dynode Dy1 for multiplying electrons supplied from the first dynode Dy1. The dynode group Dy is provided in the vicinity of the curvature center of the first dynode Dy1. A plate electrode 10 and a mesh electrode 9 are supplied with a potential intermediate between the potentials applied to the first dynode Dy1 and applied to the dynode group Dy. Accordingly, the electric field formed due to the potential difference between the first dynode Dy1 and the dynode group Dy is surrounded by the intermediate potentials. The electric field is therefore uniformly distributed over the region from the vicinity of the first dynode Dy1 toward the dynode group Dy.

27 Claims, 9 Drawing Sheets

ELECTRON MULTIPLIER

BACKGROUND OF THE INVENTION

1. Field of the Invention

The present invention relates to an electron multiplier for multiplying incident electrons by a series of dynodes.

2. Description of the Related Art

An electron multiplier is for multiplying electrons to produce current amplification. The electron multiplier is provided with an array of successively disposed dynodes. When an electron impinges on a first dynode in the array, the first dynode emits secondary electrons, which impinge on a second dynode, which further emits secondary electrons, and so on. In this way, electrons are successively multiplied by the series of dynodes. The electrons will be finally collected by an anode. Photomultiplier tubes are examples of electron multipliers wherein successive dynodes are provided between its photocathode and anode.

Conventionally, various types of electron multipliers have been proposed. However, as described below, conventional multipliers have an insufficient multiplication rate, that is, an insufficient rate, at which electrons are multiplied.

Japanese Patent Application Kokai No. 2-291656 describes an electron multiplier in which dynodes are arranged in a configuration resembling a Venetian blind as shown in FIG. 1. Electrons travel along various paths before falling incident on the dynodes. For example, an electron that travels along a path "b" will strike a dynode of a first row 101. However, an electron that travels along another path "a" passes between adjacent dynodes in the first row 101 to directly strike a dynode in the second row 102. As a result, the electron that travels along path "a" will not be multiplied by the dynode in the first row 101.

SUMMARY OF THE INVENTION

The present inventors have further investigated how electrons travel within this conventional electron multiplier.

In this electron multiplier, a mesh electrode is provided above each dynode row, thereby forming a mesh-dynode pair. The mesh electrode and the dynode of each pair is applied with the same electric voltage. For example, a mesh electrode 100, provided above the first dynode row 101, is applied with the same electric voltage as dynodes in the first row 101. As in general electron multipliers, dynodes of the second row 102 are applied with a higher electric voltage than are those of the first row 101. As shown in FIG. 2, equipotential surfaces indicated by broken lines are developed in spaces around the dynodes in the first row 101. An equipotential surface S1 has the same potential as do dynodes in the first row 101. An equipotential surface S2 has a lower potential than do dynodes in the first row 101. As apparent from the figure, the equipotential surface S2 protrudes downward and approaches near the face of the upper part of each dynode of the first row 101.

Electrons traveling along paths "d" and "e" strike the lower parts of a dynode of the first row 101, which generates secondary electrons as a result. The secondary electrons travel toward a dynode Of the second row 102 along electric lines of force which are normal to the equipotential surfaces. On the other hand, an electron travelling along another path "c" strikes the upper part of the dynode of the first row 101. Generated secondary electrons are attracted back to the dynode because the dynode has a greater potential than does the nearest equipotential surface, that is, the equipotential surface S2. Because those secondary electrons will not travel to the second dynode 102, the multiplication rate of the electron multiplier becomes lowered.

Japanese Patent Application Kokai Nos. 2-33847 and 2-54859 have proposed another electron multiplier, in which a first dynode 103 and a dynode group 104 are arranged in the manner shown in FIG. 3. The dynode group 104 is constructed from successive dynodes. In the drawing, equipotential surfaces are indicated by broken lines. An equipotential surface S1 has the same potential as does the first dynode 103. An equipotential surface S2 has a lower potential than does the first dynode 103. As apparent from the drawing, the equipotential surface S2 protrudes downward and approaches near the face of the upper part of the first dynode 103. Electrons that travel along the paths "f" and "g" strike the first dynode 103, which generates secondary electrons as a result. The secondary electrons travel toward the dynode group 104. An electron travelling along another path "h" strikes the upper portion of the dynode 103. Generated secondary electrons are attracted back to the dynode 103 because the dynode 103 has a greater potential than does the nearest equipotential surface, that is, the equipotential surface S2. Accordingly, those electrons will not travel to the dynode group 104.

It is additionally noted that as shown in the drawing, electrons that have travelled along the different paths "f" and "g" strike the first dynode 103 at different positions. Generated secondary electrons proceed along different paths to the dynode group 104. The lengths of these travelling paths are different from one another. Accordingly, these electrons take different times to travel from the dynode 103 to the dynode group 104. In other words, as the electron incident position on the dynode 103 changes, the travelling path, along which the generated secondary electrons travel to the dynode group 104, also changes. Accordingly, the times taken by secondary electrons to travel to the dynode group 104 vary greatly.

Japanese patent Application Kokai No. 5-114384 has proposed another photomultiplier tube having a first dynode 108, a second dynode 109, a third dynode 105, a fourth dynode 111, and so on arranged as shown in FIG. 4. A pole electrode 106 and the fourth dynode 111 are applied with the same electric voltage. Another pole electrode 110 and the second dynode 109 are applied with another same electric voltage. According to this arrangement, only those secondary electrons emitted from a region (referred to as an effective region hereinafter) A of the first dynode 108 will properly enter the second dynode 109. Secondary electrons generated at regions other than the effective region A of the first dynode 108 will fail to arrive at the second dynode. For example, secondary electrons emitted from a portion "i" on the first dynode 108 will strike the back side of the third dynode 105. Also, secondary electrons emitted from another portion "j" will strike the pole electrode 106. Secondary electrons emitted from still another portion "k" travel back to a focus electrode 107. Accordingly, the electron multiplication rate is still low in this photomultiplier tube.

Japanese patent Application Kokai No. 63-254652 has proposed another photomultiplier tube having a first dynode 113, a second dynode 114, a third dynode 115, and so on arranged as shown in FIG. 5. A mesh electrode is provided in confrontation with each dynode. A mesh electrode 112, provided in confrontation with the first dynode 113, is applied with the same electric voltage applied to the first dynode 113. With this arrangement, secondary electrons emitted from the upper part of the first dynode 113 will fail to enter the second dynode 114, but will directly arrive at the third dynode 115. Accordingly, the electron multiplication rate is still low in this photomultiplier tube. Additionally, secondary electrons take various lengths of time to travel from the first dynode 113 to the second dynode 114 and so on.

Japanese patent Application Kokai No. 2-227951 proposes still another photomultiplier tube having a first dynode 121, a dynode group 123, and a grid electrode 120 arranged as shown in FIG. 6. The grid electrode 120 is applied with the same electric voltage with the first dynode 121. As apparent from the figure, secondary electrons take differing lengths of time to travel from the first dynode 121 to the dynode group 123.

As described above, in the conventional electron multipliers, the incident efficiency with which secondary electrons can enter the second dynode will vary greatly according to the electron impinging position on the first dynode. The amount of time taken by the secondary electrons to travel from the first dynode toward the second dynode also varies greatly.

The present invention is attained to solve the above-described problems. An object of the present invention, is therefore to provide an electron multiplier in which distribution in the electron incident efficiency to the second dynode can be restrained and in which distribution in the period taken by electrons to reach the second dynode can also be restrained.

To achieve the above object and other objects, the present invention provides an electron multiplier for multiplying electrons, the electron multiplier comprising: a mesh electrode for allowing electrons to pass therethrough from a first side to a second side, the mesh electrode being applied with a first electric voltage; a first dynode provided in the second side of the mesh electrode in confrontation with the mesh electrode, for receiving electrons having passed through the mesh electrode and for emitting secondary electrons, the first dynode being applied with a second electric voltage lower than the first electric voltage; and a second dynode provided in the second side of the mesh electrode in confrontation with the first dynode, the second dynode being applied with a third electric voltage higher than the first electric voltage for receiving the secondary electrons emitted from the first dynode and for emitting secondary electrons.

According to another aspect, the present invention provides an electron multiplier for multiplying electrons, the electron multiplier comprising: an electron inputting portion for receiving electrons to be multiplied; a first dynode for receiving electrons from the electron inputting portion and for emitting secondary electrons; a second dynode, provided in confrontation with the first dynode and applied with an electric voltage higher than that applied to the first dynode, for electrostatically attracting the secondary electrons from the first dynode; and a wall electrode provided for separating the first and second dynodes from the electron inputting portion, the wall electrode being formed with a first incident opening, the first incident opening being covered with a mesh electrode for allowing electrons from the electron inputting portion to pass therethrough to impinge the first dynode, the wall electrode and the mesh electrode being applied with an electric voltage intermediate between the electric voltages applied to the first and second dynodes.

According to still another aspect, the present invention provides an electron multiplier for multiplying incident electrons and for outputting the multiplied electrons, the electron multiplier comprising: a mesh electrode provided at a first incident opening for receiving electrons to be multiplied; an electron multiplication portion for multiplying, in cascade manner, the incident electrons having passed through the first incident opening; an anode for collecting the electrons multiplied by the electron multiplication portion, wherein the electron multiplication portion includes: a first dynode, applied with a predetermined electric voltage, for receiving the electrons having passed through the first incident opening to thereby emit secondary electrons; a second dynode, provided in confrontation with the first dynode, for receiving the secondary electrons from the first dynode to emit secondary electrons accordingly, the second dynode having a second incident opening for allowing the secondary electrons from the first dynode to pass therethrough to impinge the second dynode, the second dynode being applied with an electric voltage higher than that applied to the first dynode; and an auxiliary electrode provided in a space located between the first and second dynodes to extend in a direction substantially orthogonal to the mesh electrode, the mesh electrode and the auxiliary electrode being applied with an intermediate electric voltage which is higher than the electric voltage applied to the first dynode and which is lower than the electric voltage applied to the second dynode, the second incident opening being located in a gap between the mesh electrode and the auxiliary electrode.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
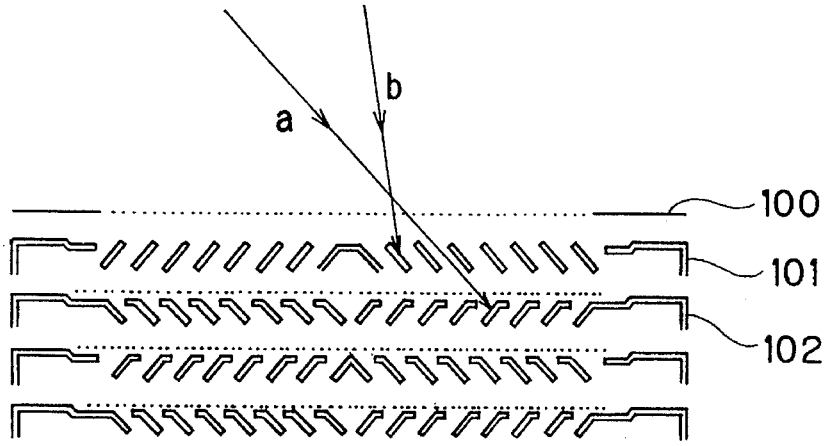
FIG. 1 is an illustrative view of an electron multiplication portion of a conventional electron multiplier.
Figure 2:
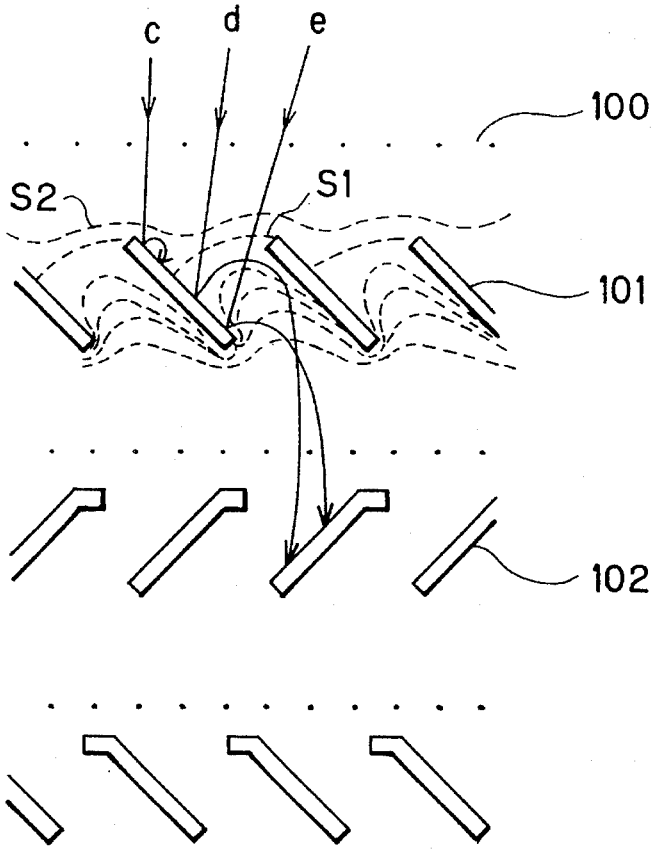
FIG. 2 is an enlarged view of an essential part of FIG. 1.
Figure 3:
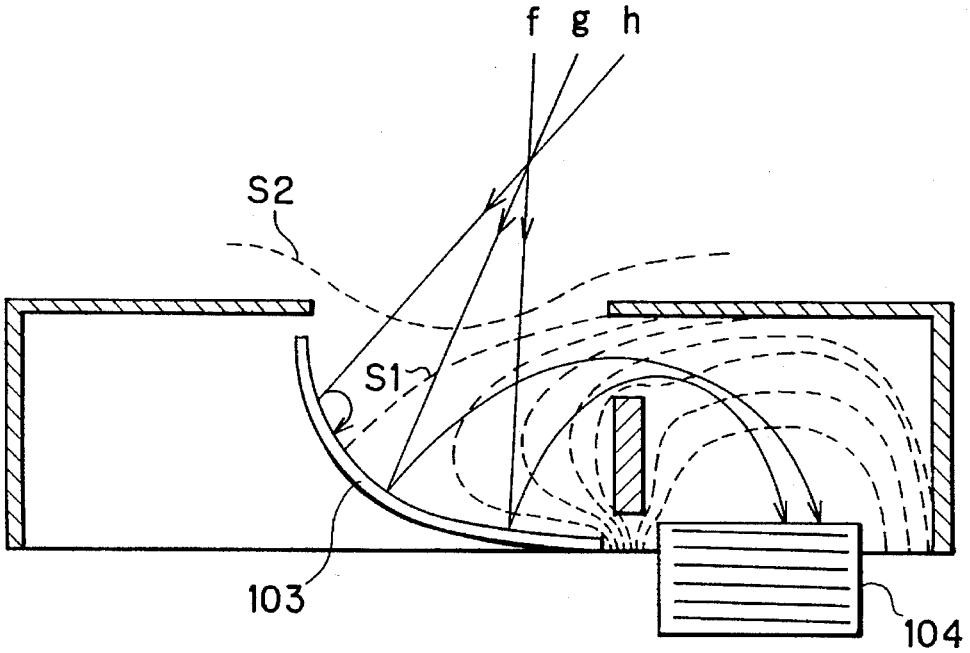
FIG. 3 is an illustrative view of an electron multiplication portion of another conventional electron multiplier.
Figure 4:
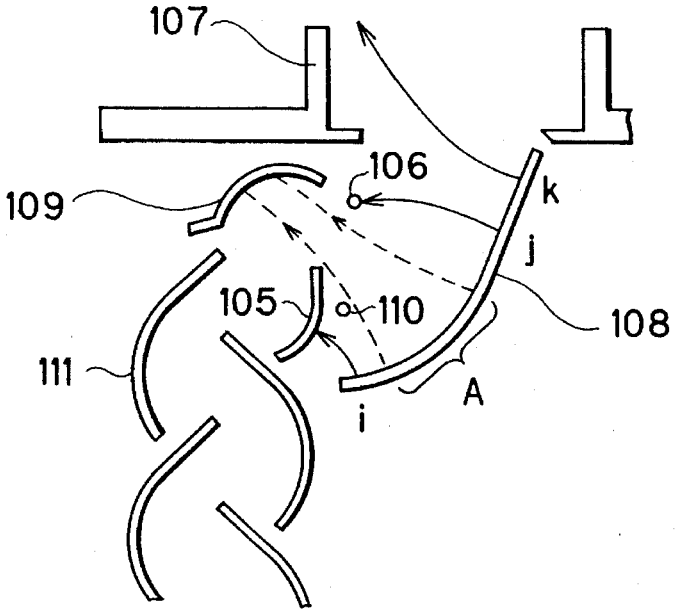
FIG. 4 is an enlarged illustrative view of an essential part of an electron multiplication portion of a still another conventional photomultiplier tube.
Figure 6:
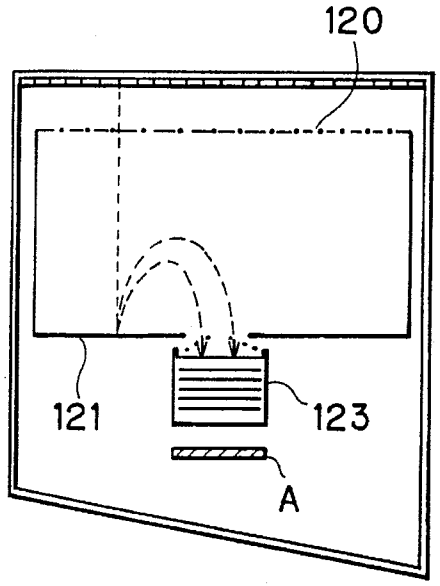
FIG. 6 is an illustrative view of still another conventional photomultiplier tube.
Figure 5:
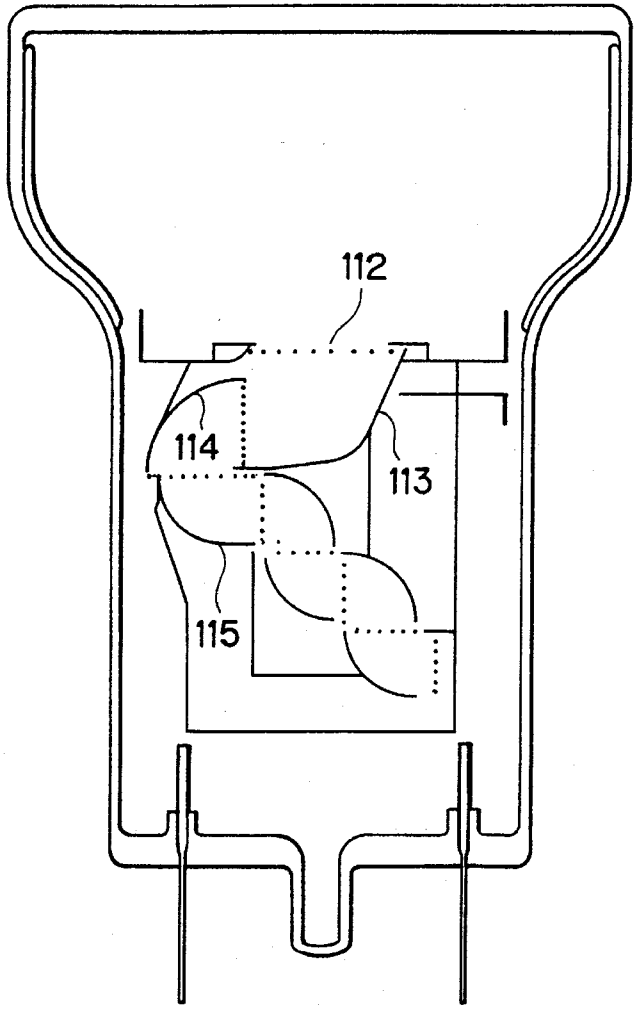
FIG. 5 is an illustrative view of another conventional photomultiplier tube.

Referring to the accompanying drawings, the following text will describe in detail preferred embodiments of the invention wherein like parts and components are designated by the same reference numerals.

Figure 7:
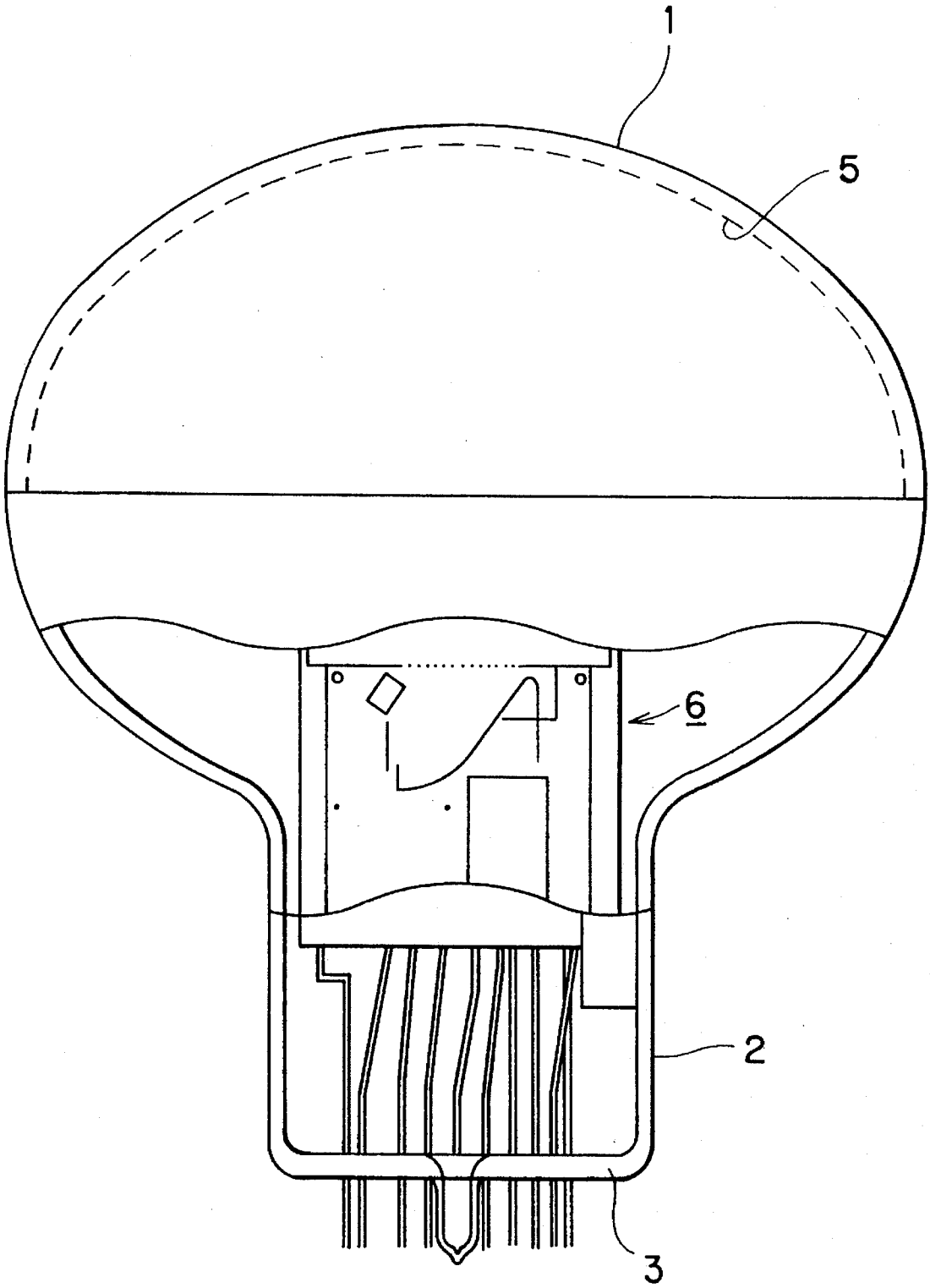
FIG. 7 is a front view showing an outer view of a photomultiplier tube of a preferred embodiment of the present invention with an internal portion visible.

FIG. 7 shows a photomultiplier tube of a first preferred embodiment of the present invention.

The photomultiplier tube includes a vacuum chamber constructed from a substantially spherical light-receiving surface 1, a bulb portion 2, and a cylindrical stem portion 3 serving as a stand base. A photoelectric cathode 5 is formed on the inner surface of the light-receiving surface 1. Light incident on the light-receiving surface 1 is irradiated on the photoelectric cathode 5, whereupon photoelectrons emit from the photoelectric cathode 5. An electron multiplication portion 6 is provided in confrontation with the photocathode 5 for multiplying photoelectrons supplied from the photocathode 5.

Figure 8:
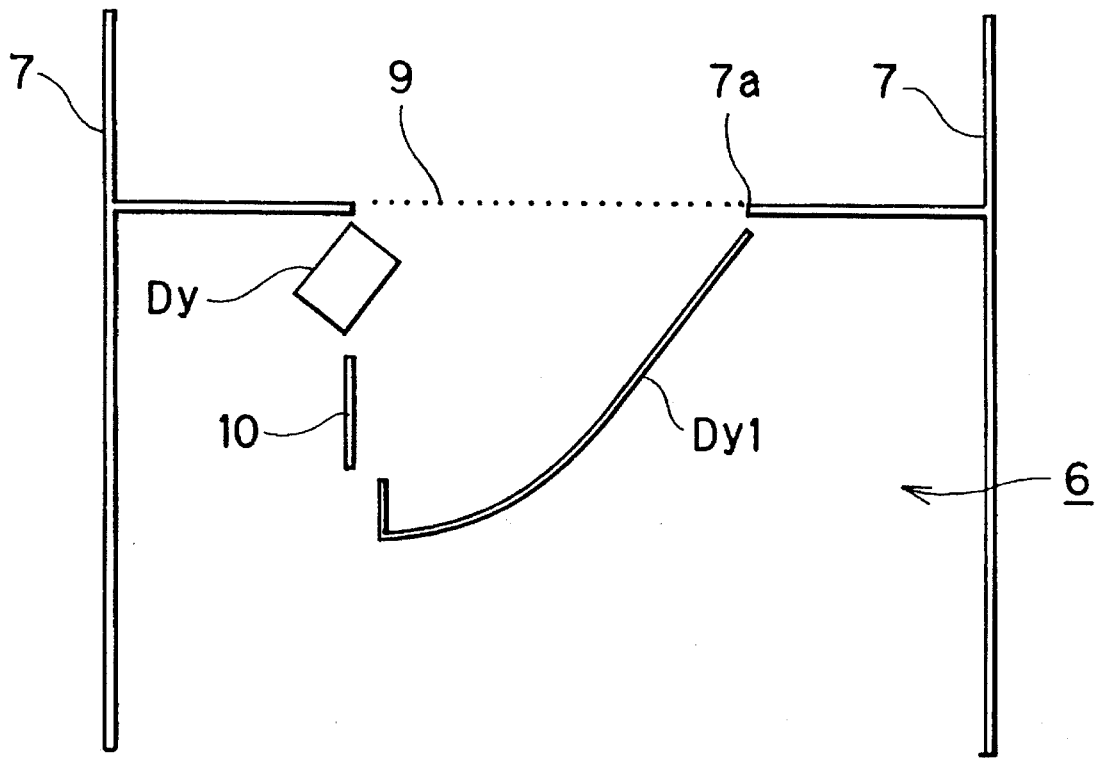
FIG. 8 is an enlarged view of an essential part of the photomultiplier tube of FIG. 7.

FIG. 8 shows an enlarged view of the electron multiplication portion 6. The portion 6 is accommodated in a focus electrode 7 substantially of a rectangular parallelepiped shape. The electrode 7 is for shielding the electron multiplication portion 6 against influences from the potential of the photocathode 5. The rectangular parallelepiped electrode 7 is opened at its bottom portion facing the stem 3. The focus electrode 7 has an incident opening 7*a* at its top portion facing the photocathode 5. The incident opening 7*a* is covered with a mesh electrode 9. As shown in the drawing, walls protrude around the incident opening 7*a* in a direction toward the photocathode 5. The walls are for converging photoelectrons from the photocathode 5 toward the incident opening 7*a*. The focus electrode 7 and the mesh electrode 9 are connected and applied with the same electric potential.

A first dynode Dy1, for receiving photoelectrons having passed through the incident opening 7*a* and for emitting secondary electrons accordingly, is provided in confrontation with the incident opening 7*a*. The first dynode Dy1 is of a curved shape resembling a quarter section of the cylinder. The curvature of the dynode Dy1 is smallest nearest the incident opening 7*a*and gradually increases with distance from the incident opening 7*a*. A dynode group Dy is provided in confrontation with the first dynode Dy1. The dynode group Dy is located at a position in the vicinity of the center of curvature of the first dynode Dy1.

Figure 9:
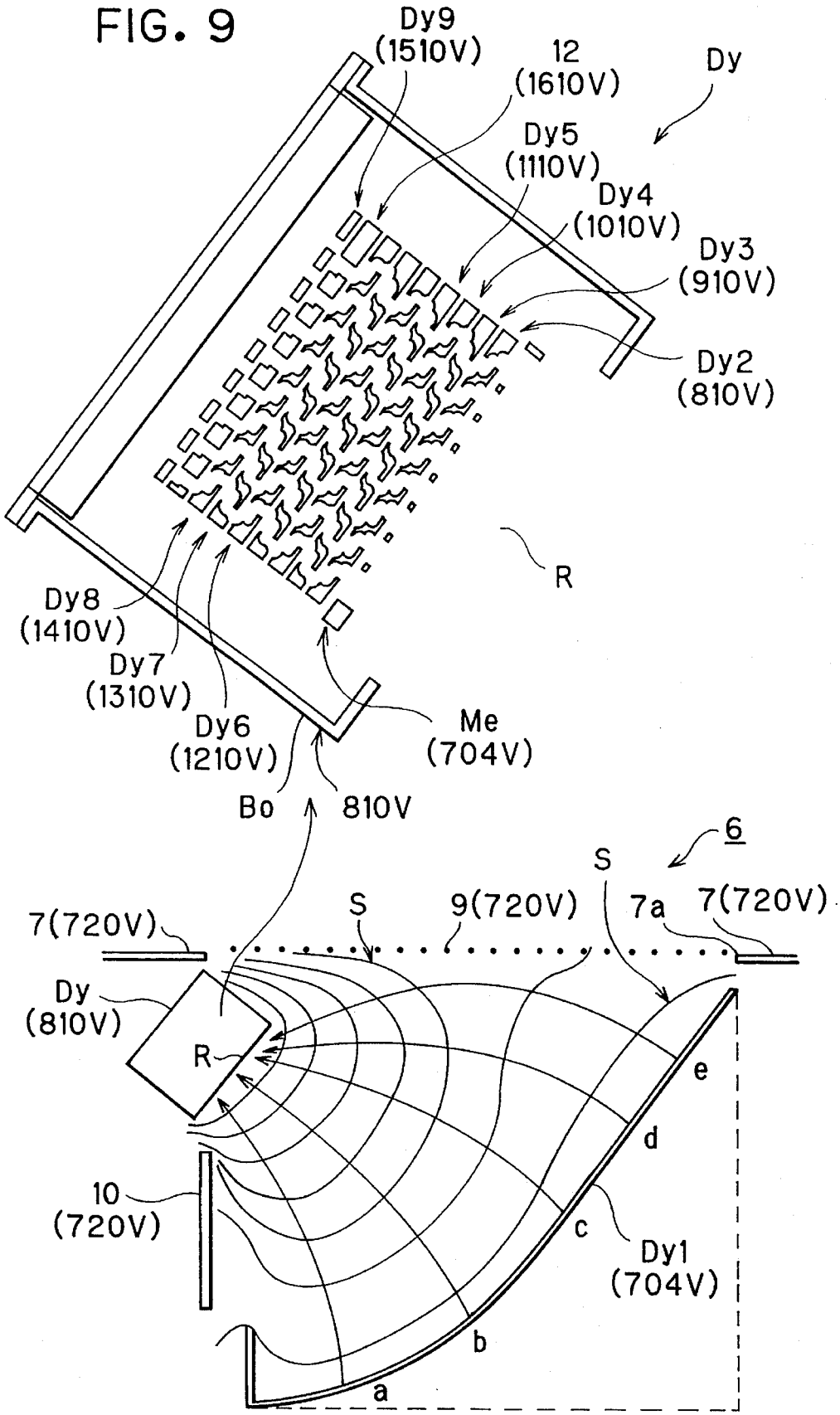
FIG. 9 shows how the equipotential surfaces are distributed in the space between a first dynode and a dynode group in FIG. 8 and also shows an enlarged view of a dynode group provided in the photomultiplier tube of FIG. 8.

An enlarged view of the dynode group Dy is shown in FIG. 9. As shown in the drawing, the dynode group Dy includes a mesh electrode Me, second through eighth rows of dynodes Dy2–Dy8, an anode 12, and a ninth row of dynodes Dy9 which are arranged in a laminated structure and which are enclosed by a rectangular metal box Bo. The metal box Bo includes an opening region R. The metal box Bo is oriented so that the opening region R confronts the first dynode Dy1 so that electrons from the first dynode Dy1 enter the metal box Bo by passing through the opening region R. In the dynode group Dy, electrons are multiplied in cascade manner by the second through eighth dynode rows Dy2–Dy8 before being collected by the anode 12.

Because the dynode group Dy is located substantially at the center of curvature of the first dynode Dy1 and because secondary electrons emitted from the first dynode Dy1 travel toward the curvature center of the dynode Dy1, secondary electrons can be highly efficiently guided to the dynode group Dy1. Additionally, secondary electrons emitted from each area on the dynode Dy1 arrive at the dynode group Dy after travelling almost equal distances. Electrons travel from the first dynode Dy1 to the dynode group Dy over more uniform lengths of time.

According to the present invention, a plate electrode 10 is additionally disposed in the space between the dynode group Dy and the first dynode Dy1. The plate electrode 10 is of a rectangular plate shape having a pair of broad rectangular surfaces and two pairs of narrow rectangular edges. As apparent from FIG. 9, the plate electrode 10 has the narrow rectangular cross-section. As also apparent from FIG. 9, the plate electrode 10 is oriented so that the pair of broad surfaces and one pair of narrow edges extend in a direction normal to the sheet of drawing of FIG. 9; so that one edge of this pair confronts a side edge of the metal box Bo; and so that the other pair of narrow edges extend in a direction normal to the mesh electrode 9. The plate electrode 10 extends from near the dynode group Dy toward the farthest end of the first dynode Dy1 from the mesh electrode 9. The plate electrode 10 is supplied with an electric potential the same as that supplied to the mesh electrode 9. The opening R of the metal box Bo is therefore located between the mesh electrode 9 and the plate electrode 10.

The second row of dynodes Dy2 is applied with a higher electric voltage than the first dynode Dy1. The mesh electrode 9 and the plate electrode 10 are supplied with an electric voltage which is higher than the electric voltage applied to the first dynode Dy1 and is lower than the electric voltage applied to the second dynode row Dy2. FIG. 9 shows one concrete example of electric voltages applied to respective parts of the electron multiplication portion 6. Equipotential surfaces are indicated by an S. According to this example, the first dynode Dy1 and the second dynode row Dy2 are applied with electric potentials of 704 volts and 810 volts, respectively. The metal box Bo is applied with 810 volts. The mesh electrode 9 and the plate electrode 10 are applied with an electric potential of 720 volts, which is an intermediate value between the electric potentials applied to the first dynode Dy1 and to the second dynode row Dy2. In the dynode group Dy, the mesh electrode Me is supplied with an electric potential of 704 volts. The third through eighth rows of dynodes Dy3–Dy8 are supplied with electric potentials of 910 volts, 1010 volts, 1110 volts, 1210 volts, 1310 volts, and 1410 volts, respectively. The anode 12 is applied with an electric potential of 1610 volts. The ninth dynode row Dy9 is applied with an electric potential of 1510 volts. It is noted that the photocathode 5 is applied with zero (0) volts.

As described above, the mesh electrode 9 is supplied with a voltage of an intermediate value between the voltages applied to the dynodes in the dynode group Dy and the first dynode Dy1. Accordingly, any equipotential surfaces of electric potentials, lower than the electric potential of the first dynode Dy1, will not protrude downward through the incident opening 7*a*to invade into the interior of the electron multiplication portion 6. Therefore, no points on the lower side of the incident opening 7*a*develop electric potentials lower than that of the first dynode Dy1. Accordingly, no secondary electrons emitted from the first dynode will return to the first dynode Dy1.

The electric field produced due to the potential difference between the first dynode Dy1 and the dynode group Dy is surrounded by the mesh electrode 9 and the plate electrode 10. Because both the mesh electrode 9 and the plate electrode 10 have a potential intermediate between the first dynode Dy1 and the dynode group Dy, the equipotential surfaces S are rectified to be substantially concentric around the dynode group Dy. In other words, electric lines of force uniformly converge toward the dynode group Dy. Electric fields are thus uniformly produced between the first dynode Dy1 and the dynode group Dy.

Because equipotential surfaces S are uniform in the vicinity of the first dynode Dy1, secondary electrons emitted from respective portions "a" through "e" on the first dynode Dy1 travel toward the dynode group Dy along corresponding paths indicated by arrows in the figure. Secondary electrons emitted from the first dynode Dy1 therefore all enter the dynode group Dy. In other words, the entire surface of the first dynode Dy1 serves as an effective region for successfully providing secondary electrons to the dynode group Dy. It is therefore possible to use a wider area of the first dynode Dy1 for providing secondary electrons. The dynode group Dy can highly efficiently collect secondary electrons for further multiplication.

As described above, according to the present embodiment, the mesh electrode 9 is provided over the incident opening 7*a*. The dynode group Dy is provided downstream of the first dynode Dy1 so it can multiply electrons supplied from the first dynode Dy1. The dynode group Dy is located near the curvature center of the first dynode Dy1. The plate electrode 10 and the mesh electrode 9 are supplied with a potential intermediate between the potentials applied to the first dynode Dy1 and applied to the dynode group Dy. Accordingly, the electric field formed due to the potential difference between the first dynode Dy1 and the dynode group Dy is surrounded by the intermediate potentials. The electric field is therefore uniformly distributed over the region from the vicinity of the first dynode Dy1 toward the dynode group Dy. Accordingly, secondary electrons emitted from the entire surface of the first dynode Dy1 are uniformly guided to the dynode group Dy. Because the mesh electrode is provided with the intermediate potential, secondary electrons emitted from any portion the first dynode Dy1 will reach the dynode group Dy in substantially the same length of time.

A photomultiplier tube of the second embodiment will be described below with reference to FIGS. 10 through 12.

Figure 10:
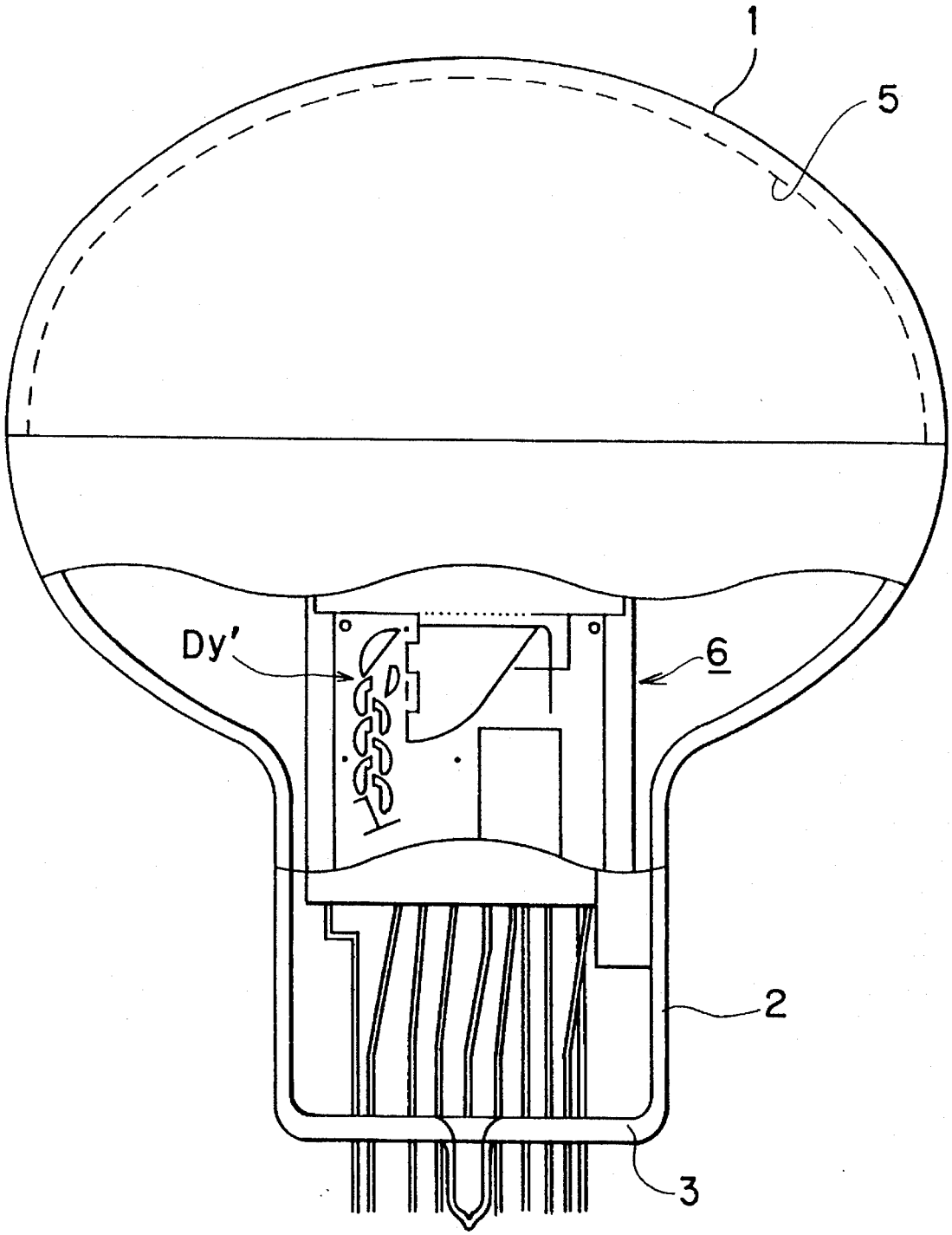
FIG. 10 is a front view showing an outer view of a photomultiplier tube of a second embodiment of the present invention with an internal portion visible.
Figure 11:
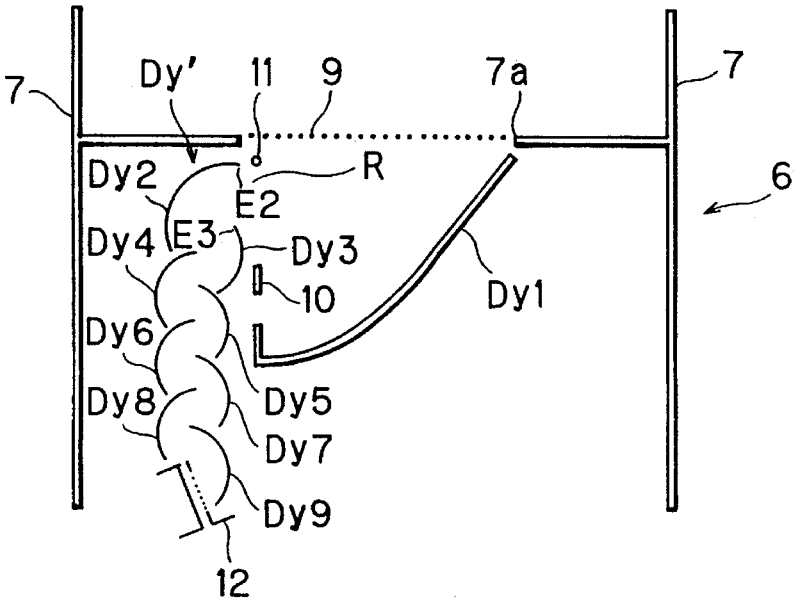
FIG. 11 is an enlarged view of an essential part of the photomultiplier tube of FIG. 10.

According to the second embodiment, as shown in FIG. 10, the dynode group Dy of the first embodiment is replaced with another dynode group Dy'. As shown in FIG. 11, the dynode group Dy' includes second through ninth dynodes Dy2–Dy9 and an anode 12 which are arranged in a line-focused manner. The dynode group Dy' has an opening region R for allowing electrons from the first dynode Dy1 to be incident on the second dynode Dy2. The opening region R is defined as a space between an end E2 of the second dynode Dy2 nearer to the mesh electrode 9 and an end E3 of the third dynode Dy3 nearer to the mesh electrode 9. According to the present embodiment, the dynode group Dy' is provided so that the opening region R is located in the vicinity of the curvature center of the first dynode Dy1.

A pole electrode 11 is additionally provided between the opening region R and the mesh dynode 9 at a position near both. The position of the pole electrode 11 confronts the curvature center of the first dynode Dy1. The pole electrode 11 is applied with an electric potential which is higher than the electric potentials of the mesh electrode 9 and of the plate electrode 10 but which is lower than the potential of the dynode Dy2. The pole electrode 11 extends along a side edge of the incident opening 7*a* in a direction normal to the sheet of drawing of FIG. 11. Parts of the photomultiplier tube of the present embodiment, other than those described above, are the same as those of the first embodiment.

According to the present embodiment, the pole electrode 11 is provided near the opening region R and is applied with the above-described potential. As shown in FIG. 12, the pole electrode 11 can upwardly shift paths along which electrons travel in the vicinity of the pole electrode 11. Accordingly, no electrons will pass through the gap between the dynodes Dy2 and Dy4. All the electrons from the first dynode Dy1 will properly enter the second dynode Dy2. Electrons can therefore be highly efficiently guided to the dynode Dy2. It is noted that the pole electrode 11 is positioned above the opening region R so that the pole electrode 11 will not be attacked by electrons that are emitted from the entire region of the first dynode Dy1 and that are travelling toward the opening region R.

Figure 12:
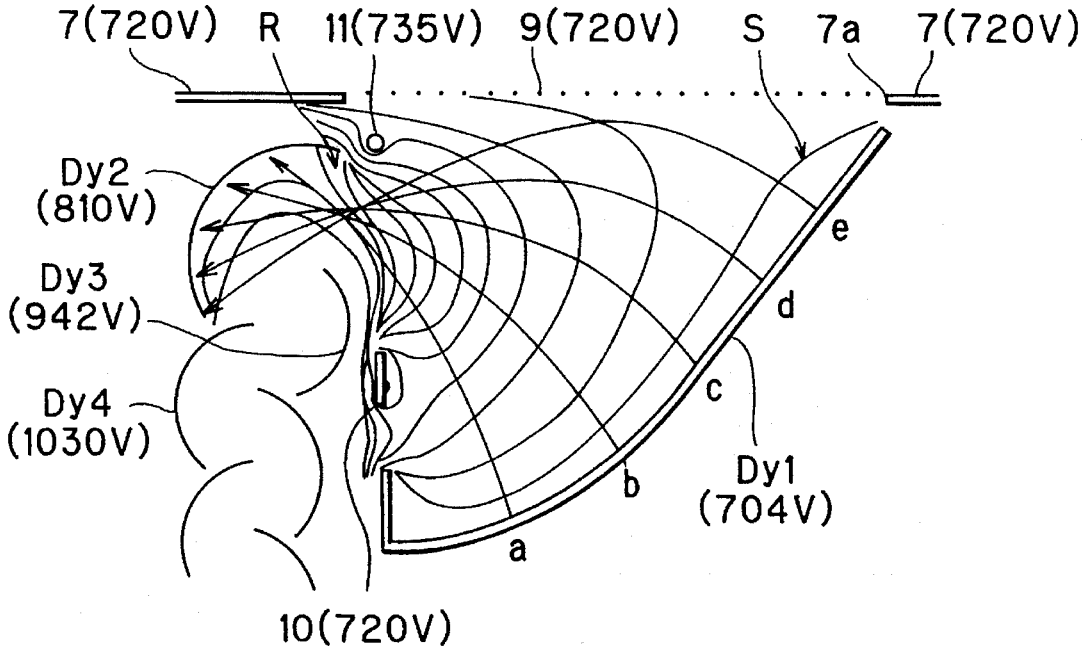
FIG. 12 shows how the equipotential surfaces are distributed in the space between a first dynode and a dynode group in FIG. 11.

FIG. 12 also shows one example of voltages applied to the respective components of the electron multiplication portion 6 of this embodiment. Equipotential surfaces S are also shown in the figure. Similarly to the example of the first embodiment, the first dynode Dy1 and the second dynode Dy2 are applied with electric potentials of 704 volts and 810 volts, respectively. The mesh electrode 9 and the plate electrode 10 are applied with an electric potential of 720 volts. The pole electrode 11 is applied with an electric potential of 735 volts. The third and fourth dynodes Dy3 and Dy4 are respectively applied with electric potentials of 942 volts and 1030 volts. The photocathode 5 is applied with zero (0) volts.

As apparent from the figure, equipotential surfaces S are rectified to be substantially concentric around the space defined between the pole electrode 11 and the plate electrode 10. The equipotential surfaces S are distributed substantially at a uniform interval. Accordingly, electric lines of force uniformly converge into the space between the pole electrode 11 and the plate electrode 10. Because electric fields are uniformly distributed in the vicinity of the first dynode Dy1, secondary electrons emitted from all the respective portions "a" through "e" on the first dynode Dy1 can travel along corresponding paths indicated by arrows in FIG. 12. All these electrons can pass through the opening region R of the second dynode Dy2, which is located between the pole electrode 11 and the plate electrode 10. Electrons emitted from the entire region of the first dynode Dy1 can therefore successfully enter the dynode Dy2.

A modification of the second embodiment will be described below with reference to FIGS. 13 and 14.

In this modification, the first dynode Dy1 is of a curved shaped forming a quarter section of an exact cylinder. The dynode Dy1 has therefore a uniform curvature. A vertical length L is defined by the distance between the incident opening 7*a* and the farthest end of the first dynode Dy1 from the incident opening 7*a*. The dynodes Dy2 through Dy9 and the anode 12 of the dynode group Dy' are accommodated within the region having the same vertical length L. The photomultiplier tube of this modification can be made compact.

Figure 14:
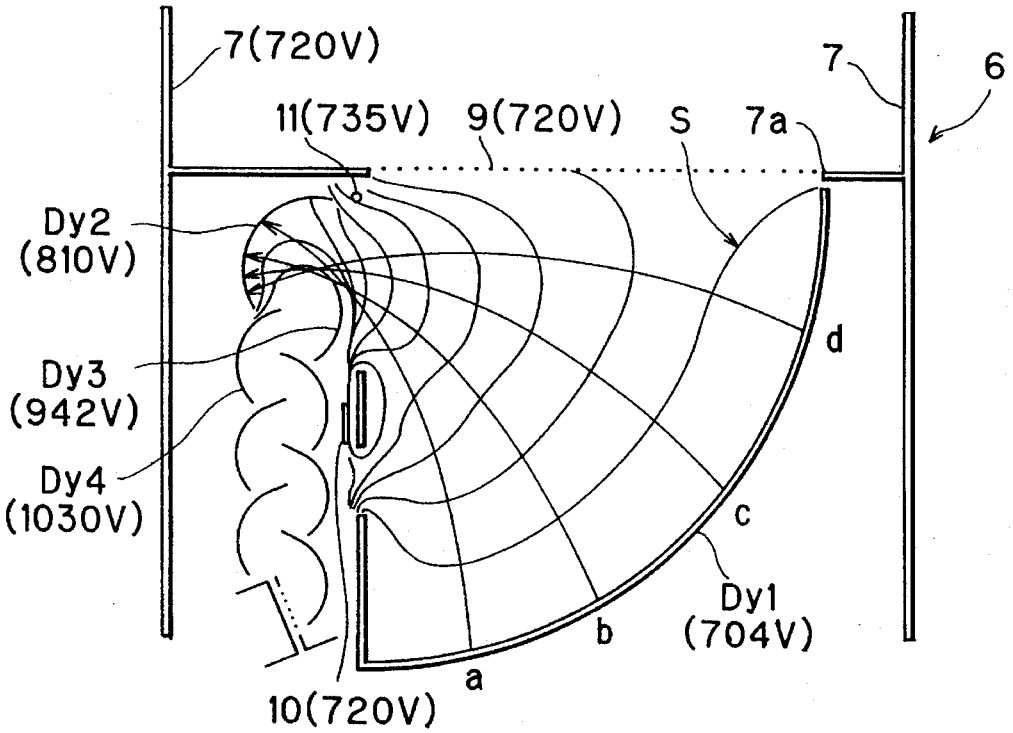
FIG. 14 shows how the equipotential surfaces are distributed in the space between a first dynode and a dynode group in FIG. 13.

As shown in FIG. 14, respective components of the multiplication portion 6 can be supplied with the same voltages as in the example shown in FIG. 12 for the second embodiment. As apparent from the figure, equipotential surfaces S are distributed uniformly concentrically about the space between the pole electrode 11 and the plate electrode 10. Electric lines of force uniformly converge toward the space between the plate electrode 10 and the pole electrode 11. Because electric fields are uniformly distributed in the vicinity of the first dynode Dy1, secondary electrons emitted from all the portions "a" to "d" on the first dynode Dy1 travel along corresponding paths as indicated by arrows in the figure. Electrons emitted from the entire region of the first electrode Dy1 can therefore successfully enter the dynode Dy2.

Figure 13:
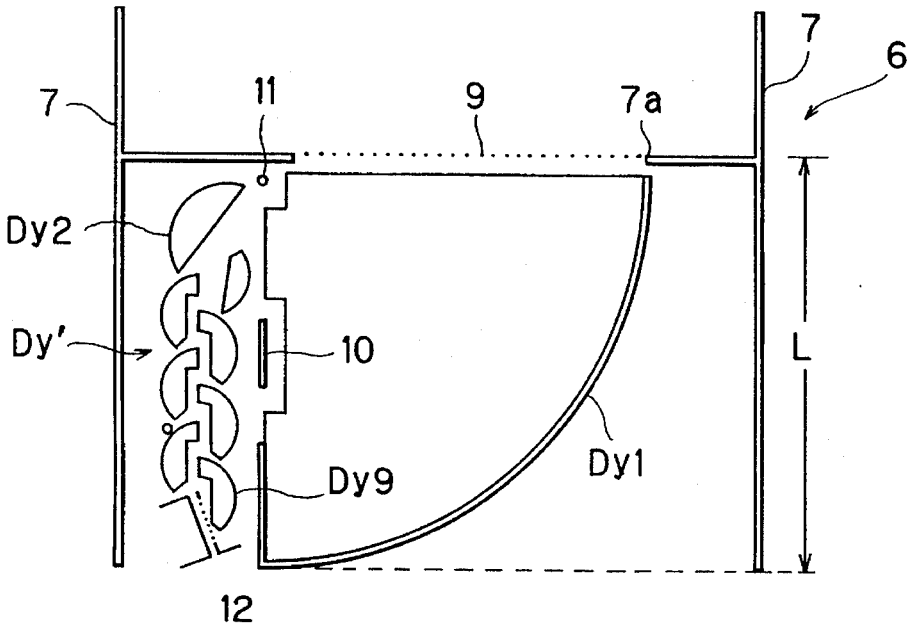
FIG. 13 is an enlarged view of an essential part of a photomultiplier tube of a modification of the second embodiment.

The above-described three types of photomultiplier tubes shown in FIGS. 7, 10, and 13 were produced. These photomultiplier tubes were driven with electric voltages as shown in FIGS. 9, 12, and 14. The conventional type of photomultiplier having an electron multiplication portion of FIG. 1 was used as a comparative example. Distribution in the time length taken by electrons to travel in each photomultiplier tube (referred to as Transit Time Spread (TTS)) was measured. The measured results are shown in the table 1 below.

TABLE 1

| | FIG. 7 | FIG. 10 | FIG. 13 | FIG. 1 |
|---|---|---|---|---|
| TTS | 0.8 nsec | 1.2 nsec | 1.4 nsec | 3.3 nsec |

Less variation in travelling time of electrons were seen in the photomultiplier tubes of the examples of FIGS. 7, 10, and 13 than was seen in the conventional photomultiplier tube of FIG. 1. It is apparent that travel time for electrons is more uniform in the photomultiplier tube of the present invention.

As described above, the electron multiplier of the present invention includes an electron multiplication portion for multiplying incident electrons. The electron multiplication portion has a first incident opening for receiving electrons to be multiplied. In the electron multiplication portion, a first dynode is provided for receiving electrons having passed through the first incident opening and for emitting secondary electrons accordingly. A second dynode is provided in confrontation with the first dynode. The second dynode is applied with an electric voltage higher than the first dynode for electrostatically attracting the secondary electrons from the first dynode. When electrons enter the electron multiplication portion through the first incident opening, electrons are multiplied in cascade manner by the first and second dynodes. Multiplied electrons are then collected up by an anode.

According to the present invention, a mesh electrode is provided over the first incident opening of the electron multiplication portion. The mesh electrode is applied with an intermediate voltage which is higher than the voltage applied to the first dynode and which is lower than the voltage applied to the second dynode. An equipotential surface of a potential lower than that of the first dynode will not protrude into the interior of the electron multiplication portion through the first incident opening. Accordingly, any secondary electrons emitted from the first dynode will not return to the first dynode. Additionally, the mesh electrode provided with the intermediate potential can control electrons emitted from the entire portion of the first dynode to travel toward the second dynode substantially over the same length of time.

According to the present invention, a first auxiliary electrode is additionally provided between the first dynode and the second dynode. The first auxiliary electrode extends in a direction substantially orthogonal to the mesh electrode. The mesh electrode and the first auxiliary electrode are applied with the intermediate electric voltage which is higher than the electric voltage applied to the first dynode and which is lower than the electric voltage applied to the second dynode. A second incident opening is defined in a gap between the mesh electrode and the first auxiliary electrode. The second dynode is located in the downstream side of the second incident opening. Secondary electrons travelling from the first dynode pass through the second incident opening before entering the second dynode. The potential difference between the first and second dynodes produces an electric field in the space between the first dynode and the second incident opening. The electric field is surrounded by the mesh electrode and the first auxiliary electrode which are applied with the intermediate voltage. Equipotential surfaces are therefore produced between the first dynode and the second incident opening by substantially a uniform interval. Electric lines of force uniformly converge from the entire portion of the first dynode toward the second incident opening. Accordingly, secondary electrons emitted from the entire portion of the first dynode can be uniformly guided to the second dynode through the second incident opening. The intermediate potentials developed on both the mesh electrode and the first auxiliary electrode can control electrons emitted from the entire region of the first dynode to travel toward the second dynode substantially in the same length of time.

Especially when the first dynode has a curved shape, substantially formed from a quarter section of a cylinder, for example, the first auxiliary electrode is located so that the second incident opening is positioned in the vicinity of the curvature center of the first dynode. Secondary electrons emitted from the entire portion of the first dynode can therefore be uniformly guided to the second incident opening. Those electrons take the same length of time to travel from the first dynode to the second dynode.

When a second auxiliary electrode is additionally provided at the second incident opening in the vicinity of the mesh electrode, the second auxiliary electrode is applied with an electric voltage higher than the electric voltage applied to the mesh electrode and lower than the electric voltage applied to the second dynode. The second auxiliary electrode can modify the equipotential surfaces so that secondary electrons will be introduced to the second dynode more efficiently.

When the dynode group is accommodated in a region occupied by the first dynode, the entire electron multiplier can be made compact.

While the invention has been described in detail with reference to specific embodiments thereof, it would be apparent to those skilled in the art that various changes and modifications may be made therein without departing from the spirit of the invention.

The above-described embodiments are directed to a photomultiplier tube. The present invention can be applied to an electron multiplier that is not provided with a photocathode. The electron multiplier may be provided with a general type of cathode as an electron source. The electron multiplier may be provided with no cathode, but may be arranged for multiplying electrons supplied from outside.

In the above-described embodiments, the first dynode Dy1 resembles a shape of a quarter section of a cylinder. However, the first dynode Dy1 can be formed into any shape. When the first dynode Dy1 has a curved surface, the second dynode should preferably be located in the vicinity of the curvature center of the curved surface of the first dynode Dy1.

As described above, according to the present invention, an electric field produced due to the potential difference between the first and second dynodes is surrounded from both sides by the mesh electrode and the auxiliary electrode (plate electrode). The mesh electrode and the auxiliary electrode are supplied with a potential intermediate between the electric potentials of the first and second dynodes. An electric field is therefore uniformly distributed from the first dynode toward the incident opening of the second dynode. Secondary electrons emitted entirely from the first dynode can be uniformly guided toward the second dynode. Electrons take substantially the same length of time to travel from the first dynode to the second dynode.

We claim:

1. An electron multiplier for multiplying electrons, the electron multiplier comprising:

a mesh electrode for allowing electrons to pass therethrough from a first side to a second side, the mesh electrode being applied with a first electric voltage;

a first dynode provided in the second side of the mesh electrode in confrontation with the mesh electrode, for receiving electrons having passed through the mesh electrode and for emitting secondary electrons, the first dynode being applied with a second electric voltage lower than the first electric voltage; and a second dynode provided in the second side of the mesh electrode in confrontation with the first dynode, the second dynode being applied with a third electric voltage higher than the first electric voltage for receiving the secondary electrons emitted from the first dynode and for emitting secondary electrons.

2. An electron multiplier of claim 1, further comprising an auxiliary electrode applied with the first electric voltage and located in the second side of the mesh electrode, the auxiliary electrode and the mesh electrode sandwitching an electric field produced between the first dynode and the second dynode.

3. An electron multiplier of claim 2, wherein the auxiliary electrode extends between the first dynode and the second dynode.

4. An electron multiplier of claim 3, wherein the auxiliary electrode extends substantially orthogonal to the mesh electrode.

5. An electron multiplier of claim 1, wherein the first dynode includes a curved surface having a center of curvature substantially at a predetermined point, the second dynode being located in the vicinity of the predetermined point.

6. An electron multiplier of claim 1, further comprising a second auxiliary electrode provided in the second side of the mesh electrode, the second auxiliary electrode being applied with a fourth electric voltage which is higher than the first electric voltage and which is lower than the third electric voltage, the second auxiliary electrode being located in the vicinity of the second dynode for rectifying the electric field in the vicinity of the second dynode.

7. An electron multiplier of claim 6, wherein the second auxiliary electrode is located between the mesh electrode and the second dynode.

8. An electron multiplier of claim 1, further comprising an electron input portion, located in the first side of the mesh electrode, for allowing electrons to pass through the mesh electrode from the first side toward the second side.

9. An electron multiplier of claim 8, wherein the electron input portion includes a cathode for emitting electrons toward the mesh electrode.

10. An electron multiplier of claim 9, wherein the cathode includes a photocathode for receiving light and for emitting electrons accordingly.

11. An electron multiplier of claim 9, wherein the electron input portion further includes a focusing electrode for guiding the electrons emitted from the cathode toward the mesh electrode.

12. An electron multiplier of claim 1, further comprising a series of dynodes for multiplying electrons emitted from the second dynode in cascade manner.

13. An electron multiplier of claim 12, wherein the second dynode and the series of dynodes are arranged in a laminated structure.

14. An electron multiplier of claim 12, wherein the second dynode and the series of dynodes are arranged in a line-focused structure.

15. An electron multiplier of claim 12, further comprising an anode for collecting the electrons multiplied by the series of dynodes.

16. An electron multiplier for multiplying electrons, the electron multiplier comprising:

an electron inputting portion for receiving electrons to be multiplied;

a first dynode for receiving electrons from the electron inputting portion and for emitting secondary electrons;

a second dynode, provided in confrontation with the first dynode and applied with an electric voltage higher than that applied to the first dynode, for electrostatically attracting the secondary electrons from the first dynode; and a wall electrodes provided for separating the first and second dynodes from the electron inputting portion, the wall electrode being formed with a first incident opening, the first incident opening being covered with a mesh electrode for allowing electrons from the electron inputting portion to pass therethrough to impinge the first dynode, the wall electrode and the mesh electrode being applied with an electric voltage intermediate between the electric voltages applied to the first and second dynodes.

17. An electron multiplier of claim 16, wherein the electron inputting portion includes an electron source for emitting electrons.

18. An electron multiplier of claim 16, further comprising a first auxiliary electrode located in a space between the first dynode and the second dynode, the first auxiliary electrode being applied with an electric voltage the same with the electric voltage applied to the mesh electrode.

19. An electron multiplier of claim 18, wherein the second dynode is provided with a second incident opening in confrontation with the second dynode for allowing electrons from the first dynode to pass therethrough to impinge the second dynode, the second incident opening being located in a gap defined between the mesh electrode and the first auxiliary electrode.

20. An electron multiplier of claim 19, wherein the first auxiliary electrode extends in a direction substantially orthogonal to the mesh electrode.

21. An electron multiplier of claim 16, wherein the first dynode has a curved surface, the first auxiliary electrode being located so that the second incident opening is positioned in the vicinity of the curvature center of the first dynode.

22. An electron multiplier of claim 16, further comprising a second auxiliary electrode provided at the second incident opening in the vicinity of the mesh electrode, the second auxiliary electrode being applied with an electric voltage higher than the electric voltage applied to the mesh electrode and lower than the electric voltage applied to the second dynode.

23. An electron multiplier of claim 17, wherein the electron source includes a photocathode for receiving light and for emitting electrons accordingly.

24. An electron multiplier for multiplying incident electrons and for outputting the multiplied electrons, the electron multiplier comprising:

a mesh electrode provided at a first incident opening for receiving electrons to be multiplied;

an electron multiplication portion for multiplying, in cascade manner, the incident electrons having passed through the first incident opening;

an anode for collecting the electrons multiplied by the electron multiplication portion, wherein the electron multiplication portion includes:

a first dynode, applied with a predetermined electric voltage, for receiving the electrons having passed through the first incident opening to thereby emit secondary electrons;

a second dynode, provided in confrontation with the first dynode, for receiving the secondary electrons from the first dynode to emit secondary electrons accordingly, the second dynode having a second incident opening for allowing the secondary electrons from the first dynode to pass therethrough to impinge the second dynode, the second dynode being applied with an electric voltage higher than that applied to the first dynode; and an auxiliary electrode provided in a space located between the first and second dynodes to extend in a direction substantially orthogonal to the mesh electrode, the mesh electrode and the auxiliary electrode being applied with an intermediate electric voltage which is higher than the electric voltage applied to the first dynode and which is lower than the electric voltage applied to the second dynode, the second incident opening being located in a gap between the mesh electrode and the auxiliary electrode.

25. An electron multiplier of claim 24, wherein the first dynode is substantially in a shape of a quarter section of a cylinder, and wherein the second incident opening is located in the vicinity of a center of curvature of the first dynode.

26. An electron multiplier of claim 24, further comprising a second auxiliary electrode located at the second incident opening in the vicinity of the mesh electrode, the second auxiliary electrode being applied with an electric voltage which is higher than the electric voltage applied to the mesh electrode and which is lower than the electric voltage applied to the second dynode.

27. An electron multiplier of claim 24, further comprising a series of dynodes for further multiplying electrons from the second dynode, wherein the second dynode, the series of dynodes, and the anode are accommodated in a region of a length L from the first incident opening where the length L is defined as a distance between the first incident opening and a farthest end of the first dynode from the first incident opening.

* * * * *